United States Patent [19]

Dyson

[11] Patent Number: 4,571,772

[45] Date of Patent: Feb. 25, 1986

[54] UPRIGHT VACUUM CLEANING APPLIANCE

[75] Inventor: James Dyson, Bathford, England

[73] Assignee: Prototypes, Ltd., Bath, England

[21] Appl. No.: 655,148

[22] Filed: Sep. 28, 1984

Related U.S. Application Data

[63] Continuation-in-part of Ser. No. 452,917, Dec. 27, 1982, abandoned, and a continuation-in-part of Ser. No. 627,110, Jul. 2, 1984, abandoned, and a continuation-in-part of Ser. No. 627,292, Jul. 2, 1984, and a continuation-in-part of Ser. No. 628,346, Jul. 6, 1984.

[51] Int. Cl.[4] ..... A47L 9/16; A47L 5/32

[52] U.S. Cl. ..... 15/335; 15/339; 15/352; 15/391

[58] Field of Search ..... 15/352, 350, 347, 339, 15/366, 383, 391, 335

[56] References Cited

U.S. PATENT DOCUMENTS

| | | | |
|---|---|---|---|
| 1,759,947 | 5/1930 | Lee . | |
| 2,184,732 | 12/1939 | Brewer | 15/352 X |
| 3,040,362 | 6/1962 | Krammes | 15/352 X |
| 3,482,276 | 12/1969 | Fillery | 15/391 X |
| 3,634,905 | 1/1972 | Boyd | 15/350 |
| 3,790,987 | 2/1974 | MacFarland | 15/328 X |
| 4,377,882 | 3/1983 | Dyson . | |

OTHER PUBLICATIONS

Technology–Apr. 25, 1983.

*Primary Examiner*—Chris K. Moore
*Attorney, Agent, or Firm*—Ian C. McLeod

[57] ABSTRACT

A vacuum cleaning appliance having dual spaced apart air conveying pipes (13, 14) supporting a cap (15) for a dirt container is described. The pipes are supported on a casing (11) mounting a movable cleaning head (10). The appliance is also convertible to a tank type cleaner using a handle (30) for the appliance.

20 Claims, 11 Drawing Figures

UPRIGHT VACUUM CLEANING APPLIANCE

CROSS-REFERENCE TO RELATED APPLICATIONS

The present application is a continuation-in-part of U.S. application Ser. No. 452,917, filed Dec. 27, 1982, and now abandoned; U.S. design application Ser. No. 627,110, filed July 2, 1984; Ser. No. 627,292, filed July 2, 1984; and Ser. No. 628,346, filed July 6, 1984; the last two of which are pending.

BACKGROUND OF THE INVENTION (1) Field of the Invention

The present invention relates to upright vacuum cleaning appliances applicable in many of its features to either an upright vacuum, a tank type vacuum or one convertible between both modes.

(2) Prior Art

A typical upright vacuum cleaner comprises a base frame which houses a motor and a vacuum cleaning nozzle head. Some type of cover is mounted over the frame to cover these components. A handle is then pivotally mounted to the frame and a collection bag is hung from the handle, with an opening in its lower end being joined to the vacuum passage extending rearwardly in the main frame from the floor engaging nozzle.

Such a construction has gained wide acceptance for bag type vacuum cleaners. The basic concept is to create a frame to which a handle is pivotally mounted and then mount or hang the various components off of these two members. U.S. Pat. No. 1,759,947 to Lee discloses a slight variation wherein a solid dust receptacle as opposed to a bag is mounted between solid support rods extending upwardly on either side of the container from the base frame. As can be seen from the patent to Lee, the concept of building a frame and then hanging components on it can result in somewhat cumbersome approaches to construction. This is particularly true where one diverges from the most conventional concept of simply hanging a collection bag from the upright handle.

The conventional upright vacuum cleaner construction also makes convertibility difficult. Many attempts have been made to provide a vacuum cleaner which is convertible in mode of operation from a conventional upright vacuum cleaner to a tank or canister-type vacuum cleaner. However, the basic construction of these two types of vacuum cleanerss is so different that convertibility has been difficult to achieve. A tank-type vacuum cleaner utilizes some type of solid canister in which a bag is mounted. A motor is then mounted on the top or on the end of the canister and draws a vacuum through a hose which is connected to a floor engaging wand. The canister travels over the floor on wheels or skids. The most common way that prior artisans have achieved convertibility in an upright-type vacuum cleaner is to provide a plate with a hose attached thereto for fixing over the floor engaging nozzle portion of the vacuum cleaner head of an upright vacuum cleaner.

These and other problems of convertibility are addressed by the various aspects of the present invention. However, most aspects of the present invention have applicability in either an upright vacuum cleaner, a tank-type vacuum cleaner or both even without regard to convertibility.

OBJECTS

It is therefore an object of the present invention to provide an improved vacuum cleaning appliance wherein a pair of spaced apart pipes provide support for a cap and collection means and provide air flow from a cleaning head to and from a casing and the cap supporting the pipes. Thus instead of creating a frame and merely hanging things from it, operating components of the present vacuum cleaner double as frame components. The vacuum cleaning appliance of the present invention is light weight and relatively economical to manufacture. These and other objects will become increasingly apparent by reference to the following description and the drawings.

IN THE DRAWINGS

GENERAL DESCRIPTION

Figure 1:
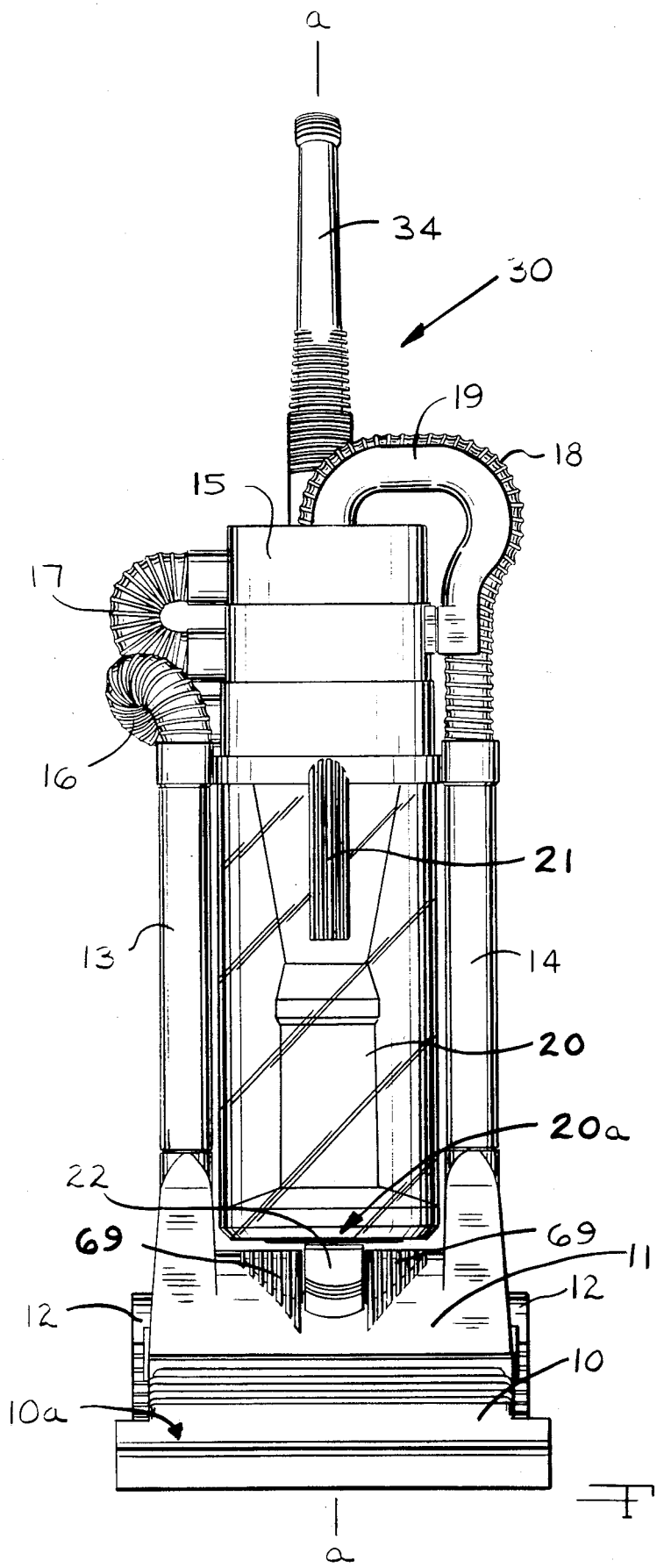
FIG. 1 is a front perspective view of the preferred upright vacuum cleaning appliance of the present invention particularly illustrating pipes (13, 14) mounted on a casing (11) leading to cap (15) on a container (20) having a longitudinal axis (a-a) between the pipes.
Figure 2:
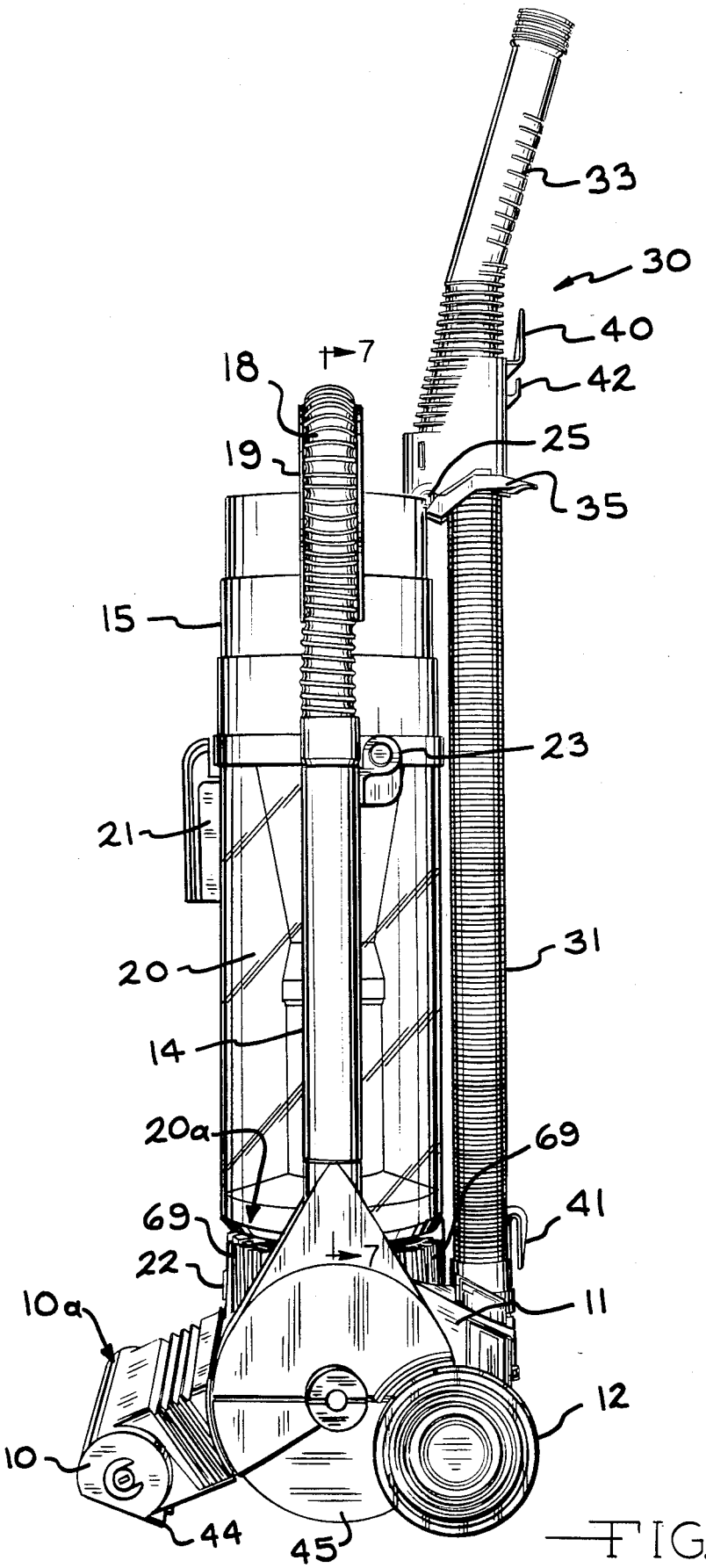
FIG. 2 is a right side perspective view of the appliance of FIG. 1.
Figure 3:
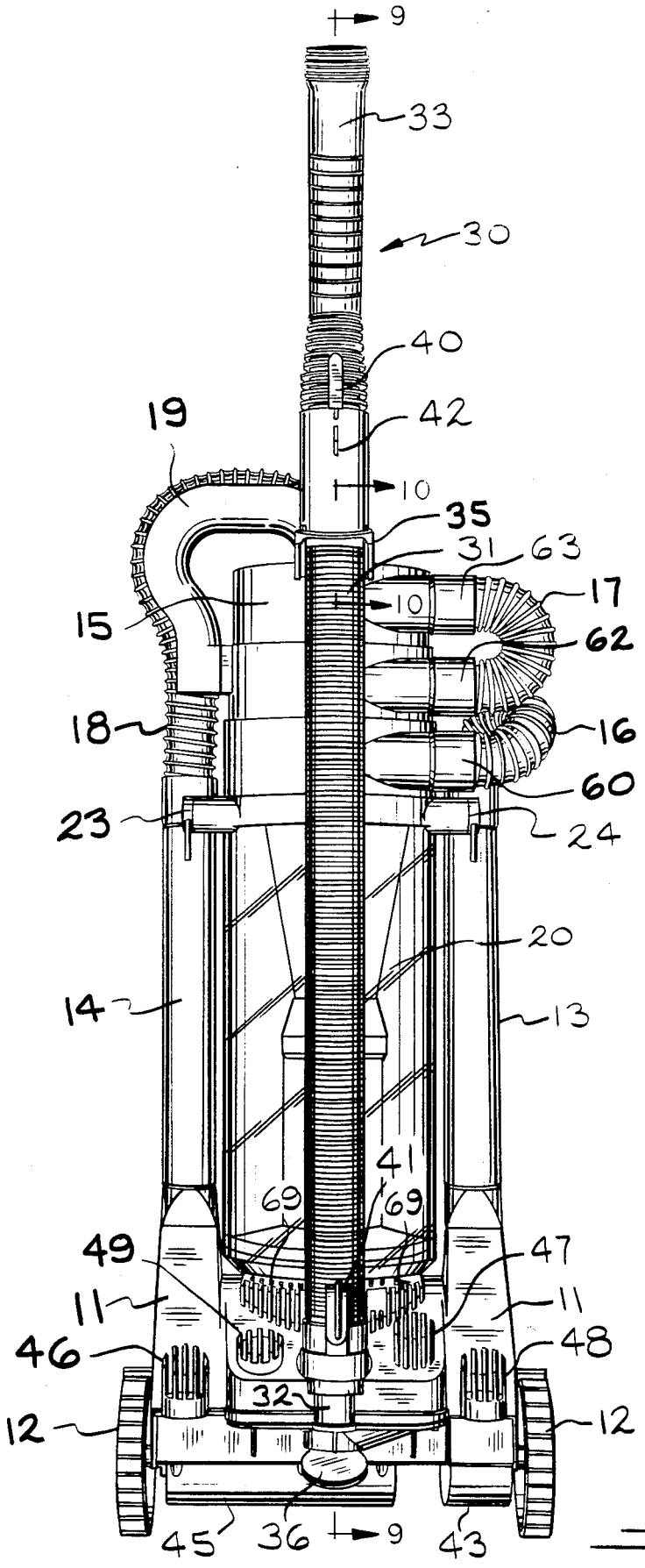
FIG. 3 is a back perspective view of the appliance of FIG. 1.
Figure 4:
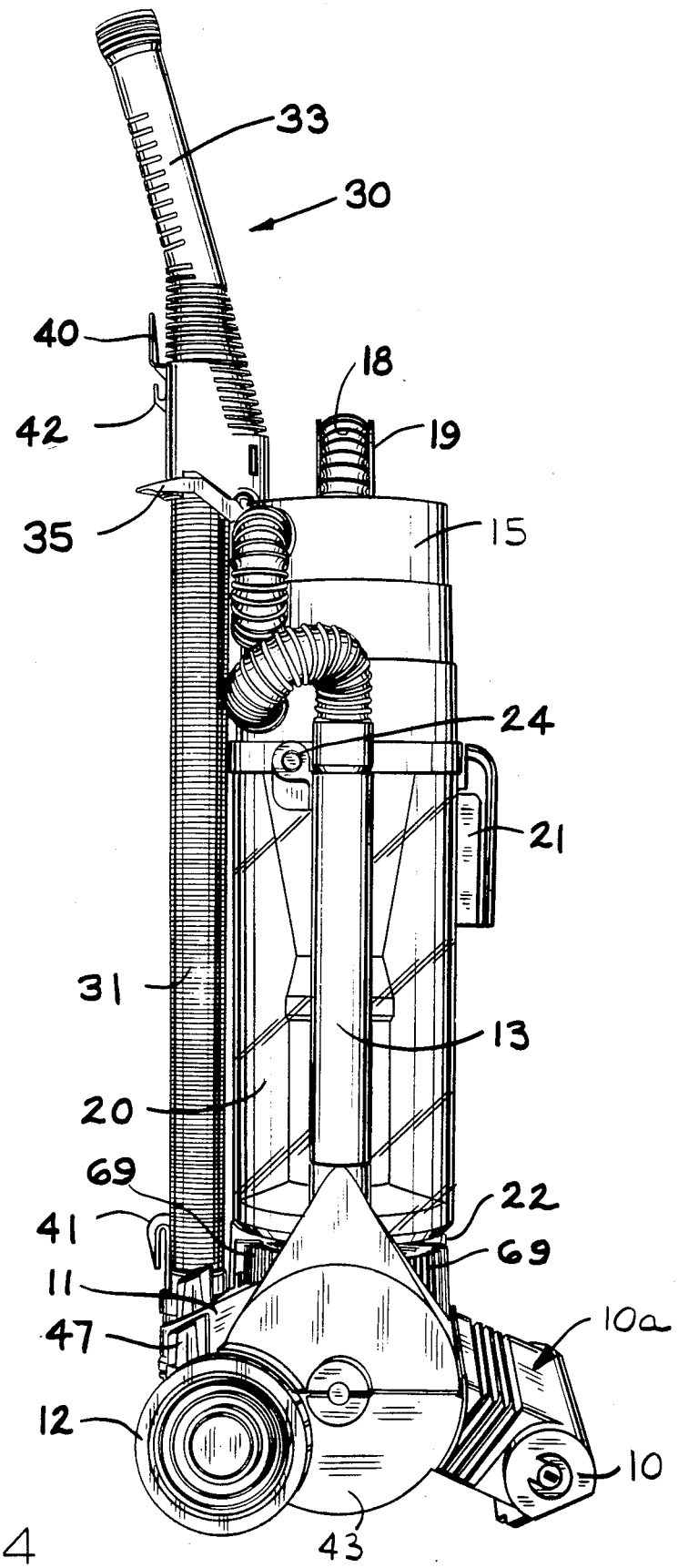
FIG. 4 is a left side perspective view of the appliance of FIG. 1.
Figure 5:
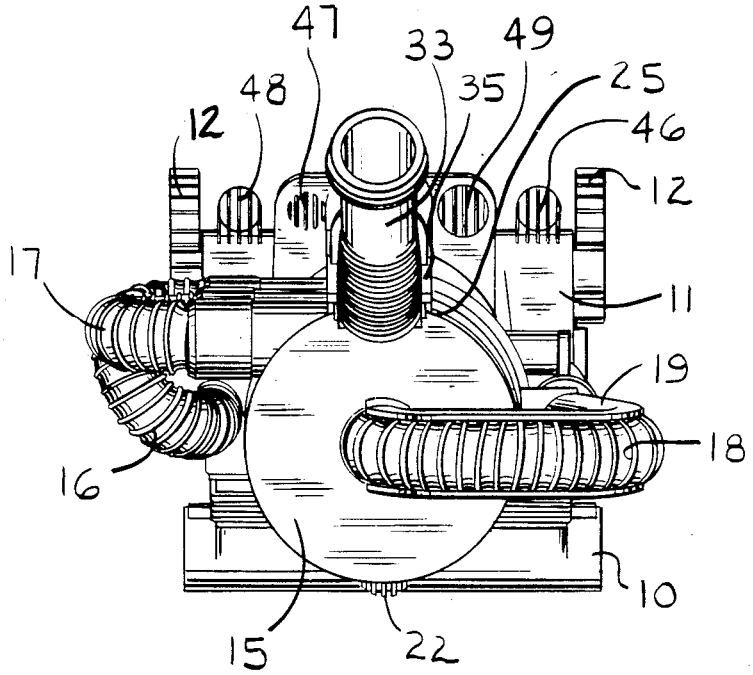
FIG. 5 is a plan perspective view of FIG. 1.

The present invention generally relates to an improved upright vacuum cleaning appliance for cleaning floors having a cleaner head (10) pivotably attached to a casing (11) and an upright dirt collection means mounted on the casing which retains dirt picked up by the cleaning head inside the collection means and a handle (30) connected to the casing or cleaning head for moving the appliance along the floor, which comprises: a collection means having an open top and a closed bottom supported on the bottom by the casing and having a longitudinal axis between the top and the bottom; a pair of spaced apart pipes (13, 14) mounted on the casing spaced from the longitudinal axis of and adjacent to the collection means and in air flow connection with the casing; and a cap (15) mounted over the open top of the collection means supported by and in air flow connection with the pipes wherein the collection means can be removed from the appliance for removal of dirt.

The present invention particularly relates to an upright vacuum cleaning appliance for cleaning floors having a casing (11) with a floor engaging cleaner head (10) and an upright dirt collection container (20) which retains dirt picked up by the cleaning head inside the collection container and a handle (30) for moving the appliance along the floor, which comprises: said container (20) having an open top and a closed bottom (20*a*) supported on the bottom by said casing and having a longitudinal axis between the top and the bottom; a pair of spaced apart pipes (13, 14) mounted on the casing and spaced from the longitudinal axis of and adjacent to the container and in air flow connection with the casing; an air flow control cap (15) mounted on the open top of the container for directing the flow of dirt laden air into said container, said cap being pivotably supported by and in air flow connection with said pipes, said container being held in place between said cap and said case and being removable when said cap is pivoted, for removal of dirt.

The present invention is particularly concerned with vacuum cleaners having dual collection chambers one inside the other in series.

SPECIFIC DESCRIPTION

FIGS. 1 to 6 show the preferred upright vacuum cleaner including a cleaning head 10, connected to a casing 11. The cleaning head 10 supports conventional floor engaging brushes (not shown). Wheels 12 are mounted on the casing 11. In the preferred apparatus the cleaning head 10 includes a cover 10*a* which is removable without tipping the appliance over. Spaced apart air pipes 13 and 14 are mounted on the casing 11 parallel to each other and are in air flow connection with a cap 15 by means of a first flexible hose 16. A second flexible hose 17 leads to and from inside the cap 15 to provide air flow as discussed in connection with FIG. 7. A third flexible tube 18 leads from the cap 15 to pipe 14. A U-shaped handle 19 is connected to the cap 15 and supports the flexible tube 18. A dirt collection container 20 is mounted on casing 11 and has a handle 21. The flexible hoses 16, 17 and 18 are preferably removable for cleaning. The container 20 preferably has a circular cross-section and more preferably is cylindrical or outward tapering if space and dimensions permit. A clip 22 is mounted on casing 11 which engages the bottom 20*a* of the container 20. Pivot hinges 23 and 24 are mounted on cap 15 and upper ends of pipes 13 and 14 which allow the cap 15 to be pivoted for removal of the container 20 as shown in FIG. 8.

Figure 6:
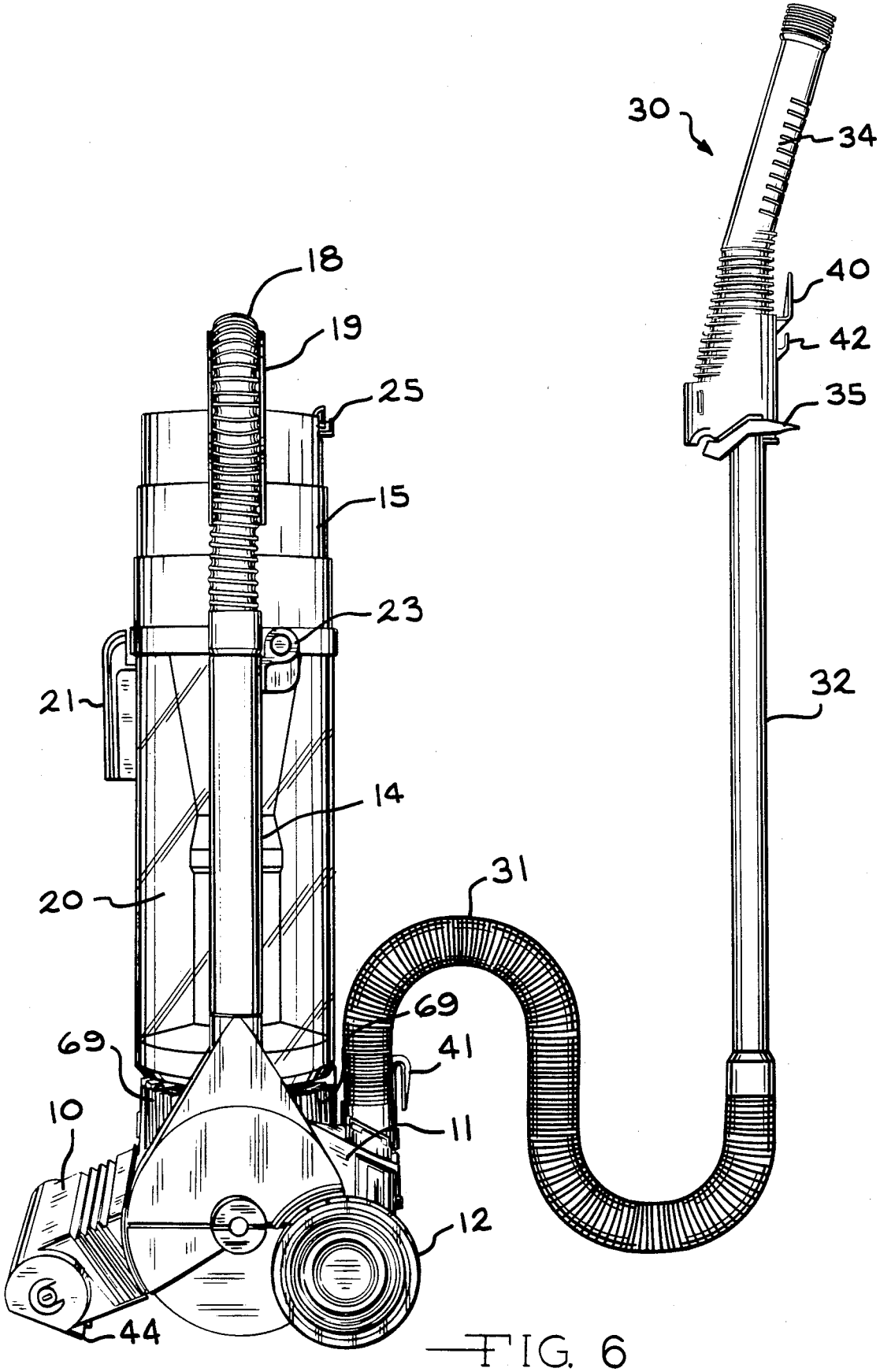
FIG. 6 is a right side perspective view similar to FIG. 2 with the handle (30) detached from the casing for use of the appliance as a canister type cleaner by providing air through a pipe (34), a pipe (32), a flexible hose (31) into casing (11).
Figures 9, 10, 11:
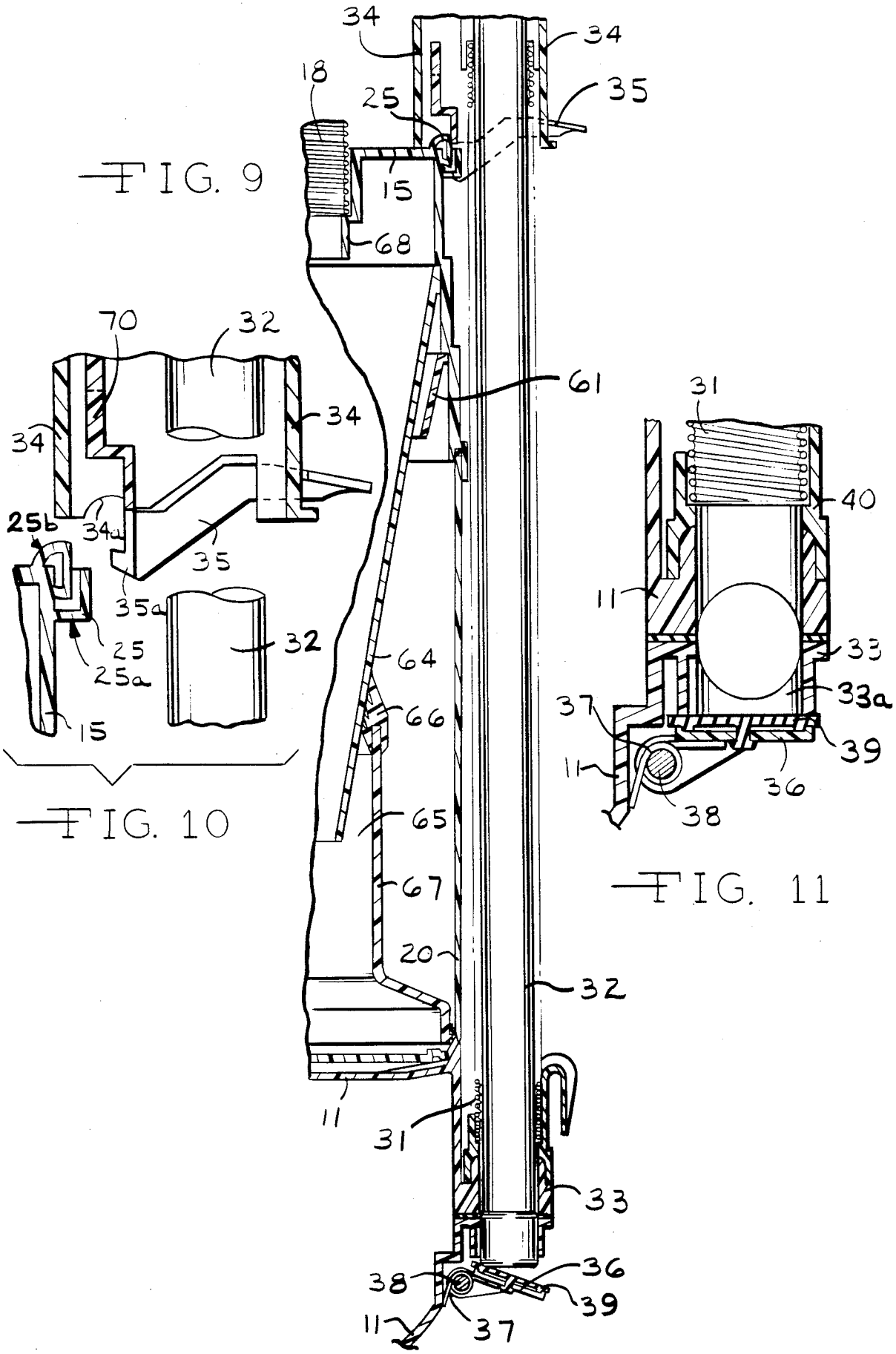
FIG. 9 is a partial cross-sectional view along line 10—10 of FIG. 3 showing the pipe (32) inserted in a socket (33) and the connected clamp (35) and extension (25).
FIG. 10 is a front partial cross-sectional view along line 10—10 of FIG. 3 particularly showing the separated construction of the clamp (35) and extension (25) of the container (20) for holding the handle (30) on the cap (15).
FIG. 11 is a partial cross-sectional view along line 11—11 of FIG. 8 showing the socket (33) with the pipe (32) removed.

A handle 30 includes a flexible hose 31 mounted on casing 11. Inside the flexible tube 31 is a rigid pipe 32, as shown in FIG. 6 which fits into a socket 33 as shown in FIG. 9. The pipe 32 includes a grip 34 supporting a clamp 35 which engages extension 25 mounted on cap 15 when the rigid pipe 32 is inside flexible tube 31 and inserted in socket 33. A flap valve 36 is open when the pipe 32 is in socket 33 to prevent any chance of suction being created at the open end of grip 34 when the appliance is in the upright position. Suction at this point in the upright position might be a danger should children, for example, look down the grip 34. The flap valve 36 closes only when pipe 32 is removed from socket 33. The valve 36 is urged to close air opening 33*a* in socket 33 by a coil spring 37 supported on casing 11 and is mounted on pin 38 as shown in FIG. 11. The valve 36 can have an elastic face 39 to provide a good seal with opening 33*a* when the pipe 32 is removed. In general, the use of the handle for tank type vacuum cleaning is described in my U.S. Pat. No. 4,377,882.

A clip 40 is provided on grip 34 and a clip 41 is provided on socket 33 for winding on an electric cord (not shown) when the cleaner is not in use. A small clip 42 is provided on grip 33 to aid in holding the electric cord away from the floor and cleaning head 10 when the cleaner is in use.

A valve mechanism 43 (FIG. 4) included as part of the cleaning head 10 on one side of the casing 11 with an air passage (not shown) leading to pipe 13 when the cleaning head 10 engages the floor. In the position shown in FIG. 4 with the pipe 32 removed from socket 33 as shown in FIG. 6, the cleaning head 10 is disconnected from air passage with the pipe 13 and air is drawn through grip 34, pipe 32, hose 31 through socket 33. A support means or bar 44, adjacent to the floor supports the cleaning head 11 such that brushes (not shown) do not engage the floor. A motor (not shown) supporting an impeller or fan (not shown) is enclosed in housing 45 attached to cleaning head 10 to provide air through pipes 13, hose 16, cleaning head 15, hose 17, cleaning head 15, hose 18, pipe 14 to the housing 45. The construction of the valve 43 is described in detail in my pending application Ser. No. 627,292, filed July 2, 1984.

Stands 46, 47 and 48 provide for mounting of conventional cleaning attachments (not shown) on the casing 11. Switch 49 allows the motor to be turned off and on.

Figure 7:
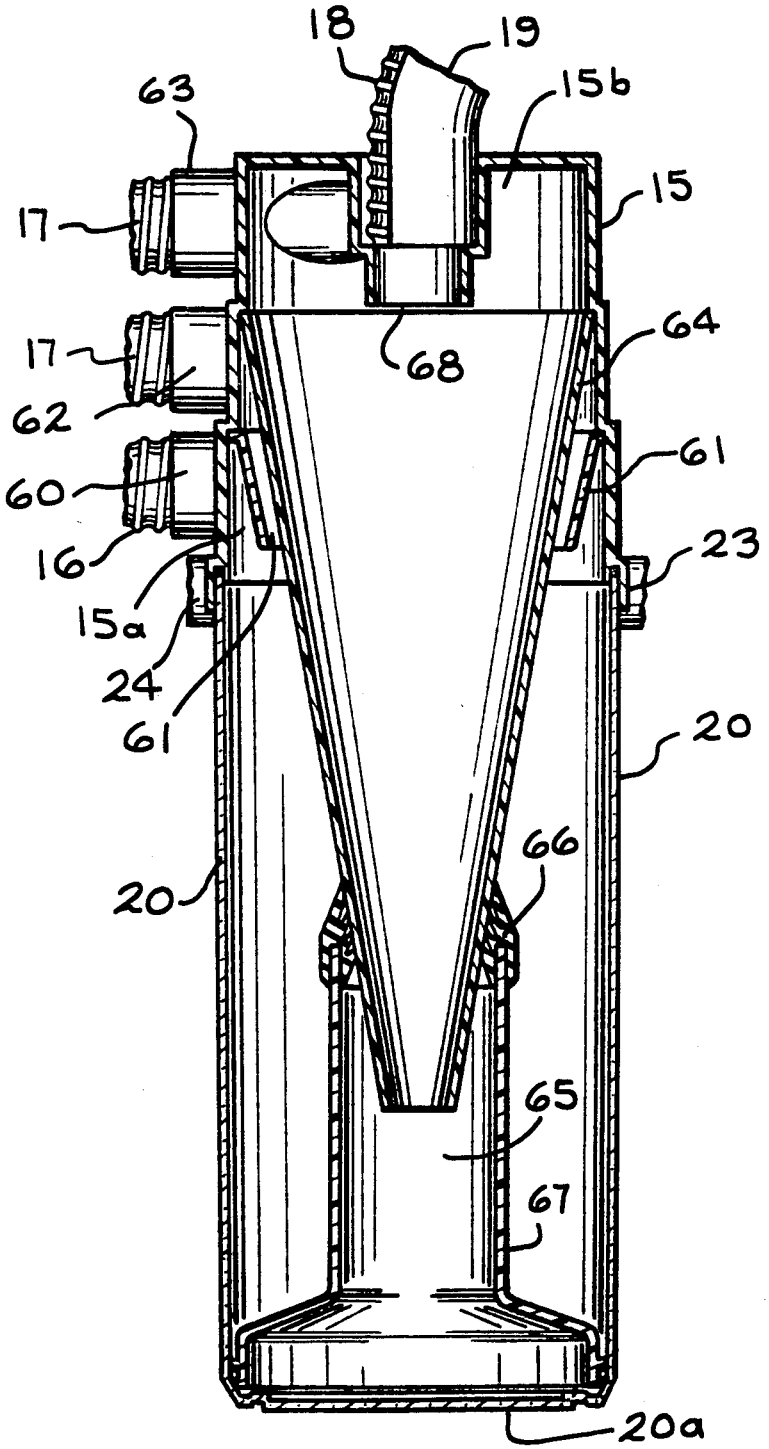
FIG. 7 is a front cross-sectional view along line 7—7 of FIG. 2.
Figure 8:
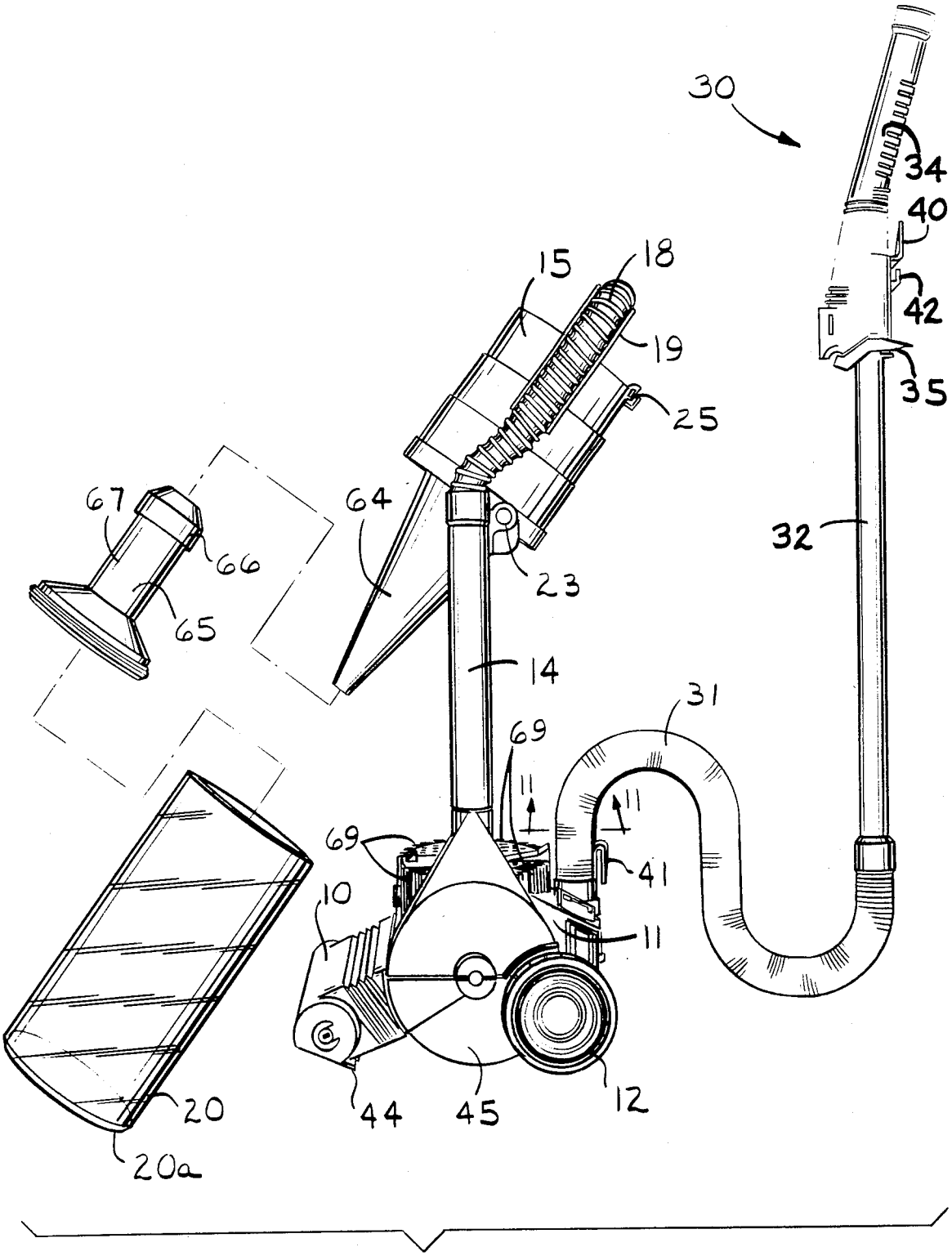
FIG. 8 is a right side perspective view of the cleaner as shown in FIG. 2 with the cap (15) tilted for removal of the container (20) from the appliance.

The preferred air flow for dirt separation in the appliance is shown by FIG. 7. The air from pipe 13 leads into hose 16 and inlet 60 and into cap 15 tangentially to the inside wall 15*a* of the cap 15, moves around the inside of container 20 and through ring 61 to flexible tube 17 and outlet 62 to second inlet 63 tangentially to the inside wall 15*b* of cap 15, through frustoconical cyclone 64 to receiving chamber 65. Seal 66 is provided between the receiving chamber 65 and cyclone 64 mounted on extension 67 of the receiving chamber 66. The air is then removed through flexible hose 18 to pipe 14 through second outlet 68. As can be seen from FIG. 8, the receiving chamber 65 can be removed from the container 20 for ease of cleaning. The cap 15 is tilted with the pipe 32 disengaged from socket 33 by disengaging champ 35 from extension 25 and by pressing clip 22 which engages the bottom 20*a* of container 20. The container 20 is then removed. This series air flow through two dirt separators, i.e. container 20 and cyclone 64 is preferred and is described in detail in my U.S. patent application Ser. No. 628,346, filed July 6, 1984.

Air removal passages 69 are provided in casing 11 for removal of cleaner air from the appliance which also cools the motor in housing 45.

FIG. 10 shows the details of the preferred clamp 35 and extension 25 of cap 15. The clamp 35 is pivoted on grip 34 as by means of extension 70 supported by the grip 34. The clamp 35 has a dog 35*a* which engages the underside 25*a* of extension 25. A portion 34*a* of handle 34 engages a portion 25*b* of extension 25 to provide a firm connection.

It will be appreciated that the container could be a conventional filter bag rather than cyclone 64. Also it will be appreciated that a bag (not shown) could be used in place of the container 20, providing the motor provided air flow into the pipe 13 rather than from pipe 14. This is not preferred. Also it will be appreciated that a first impeller or fan can be provided on one end of a motor shaft for cooling the motor windings independently of the clean air and a second impeller or fan provided on an apparatus end of the motor shaft for drawing the clean air through the vacuum. These motors are referred to as "by-pass" vacuum motors (not shown). All of these variations will be obvious to one skilled in the art.

I claim:

1. In an upright vacuum cleaning appliance for cleaning floors having a casing with a floor engaging cleaner head and an upright dirt collection container which retains dirt picked up by the cleaning head inside the collection container and a handle for moving the appliance along the floor, the improvement which comprises:

(a) said container having an open top and a closed bottom supported on the bottom by said casing and having a longitudinal axis between the top and the bottom;

(b) a pair of spaced apart pipes mounted on the casing and spaced from the longitudinal axis of and adjacent to the container and in air flow connection with the casing;

(c) an air flow control cap mounted on the open top of the container for directing the flow of dirt laden air into said container, said cap being pivotably supported by and in a flow connection with said pipes, said container being held in place between said cap and said casing and being removable when said cap is pivoted, for removal of dirt.

2. The appliance of claim 1 wherein flexible hoses extend from each of said pipes to said cap to provide air flow communication therewith and facilitate said pivoting of said cap on said pipes.

3. The appliance of claim 2 wherein said cap provides tangential air entry into the container from one of the pipes and the flexible hoses to provide cyclonic air separation inside the container and wherein clean air is removed through the other of the pipes and flexible hoses.

4. The appliance of claim 3 wherein a frustoconically shaped cyclone is provided inside the container and wherein air is introduced tangentially into the cyclone from the container to produce secondary dirt separation by the cyclone and wherein the clean air is removed from the cyclone through one of the flexible hoses to one of the pipes.

5. The appliance of claim 2 wherein one of the flexible hoses is connected to the cap along the longitudinal axis of the container and wherein a U-shaped plastic extension of the cap supports the hose thereby forming a lifting handle for the appliance.

6. The appliance of claim 2 wherein the flexible hoses are removable from the pipes for cleaning.

7. The appliance of claim 2 wherein said cleaner head supports a housing for a motor for drawing air through the casing, cap, pipes and flexible hoses and wherein the motor is cooled by clean air from one of the pipes.

8. The appliance of claim 1 wherein the handle is an elongate pipe which is telescoped inside of a flexible tube and connected to said casing and detachably connected to said cap for use of the appliance as an upright cleaner with air flow through the pipes and wherein the handle can be detached from the cap and the pipe extended from the flexible tube to be in air flow connection with the casing so that the pipe can serve as a vacuuming extension for the appliance with air flow through the pipes.

9. The appliance of claim 8 wherein the casing includes a socket into which the pipe is inserted when the handle is connected to the cap.

10. The appliance of claim 9 wherein the socket supports a flap valve which is opened when the pipe is inserted in the socket to prevent any air flow through the pipe.

11. The appliance of claim 1 wherein one of the pipes provides air inlet to the cap from the casing and wherein the other pipe provides air outlet to the casing from the cap.

12. The appliance of claim 1 wherein said cleaner head is provided with a rotating brush and a cover which is removable to allow access to said rotating brush to clean and service same.

13. The appliance of claim 1 wherein the appliance includes wheels mounted on said casing opposite said cleaning head.

14. The appliance of claim 13 wherein the cleaner head is disengaged from the floor by a support means on the cleaning head when the appliance is in an upright position with the handle and longitudinal axis of the container in a vertical position.

15. The appliance of claim 1 wherein said pipes are parallel to each other and to the longitudinal axis and said container has a cylindrical cross-section.

16. The appliance of claim 1 in which said handle is connected at its base to said casing and is releasably connected along its length to said cap, whereby when connected to said cap, said cap, handle, pipes and container create a rigid, unified structure and whereby when said handle is disconnected from said cap, said cap can be pivoted to facilitate removal of said container.

17. The appliance of claim 16 in which said casing includes a clip for normally holding said container in place on said casing, but being releasable for facilitating removal of said container.

18. The appliance of claim 1 in which said casing includes a clip for normally holding said container in place on said casing, but being releasable for facilitating removal of said container.

19. In an upright vacuum cleaning appliance for cleaning floors having a cleaner head pivotably attached to a casing and an upright dirt collection means mounted on the casing which retains dirt picked up by the cleaning head inside the collection means and a handle connected to the casing or cleaning head for moving the appliance along the floor, the improvement which comprises:

(a) a collection means having an open top and a closed bottom supported on the bottom by the casing and having a longitudinal axis between the top and the bottom;

(b) a pair of spaced apart pipes mounted on the casing and spaced from the longitudinal axis of and adjacent to the collection means and in air flow connection with the casing; and (c) a cap (15) mounted over the open top of the collection means supported by and in a flow connection with the pipes wherein the collection means can be removed from the appliance for removal of dirt.

20. The upright vacuum cleaning appliance of claim 19 wherein said cleaner head has a rotating brush mounted therein, and wherein said cleaning head includes a cover removably mounted thereon whereby said cover can be removed to allow access to said rotating brush to clean and service same without having to tip said vacuum cleaner on its side or to invert it.

* * * * *

UNITED STATES PATENT AND TRADEMARK OFFICE

CERTIFICATE OF CORRECTION

PATENT NO. : 4,571,772

DATED : February 25, 1986

INVENTOR(S) : James Dyson

It is certified that error appears in the above-identified patent and that said Letters Patent are hereby corrected as shown below:

On the face page of patent "Serial No. 627,110, Jul. 2, 1984, abandoned" should read --Serial No. 627,110, Jul. 2, 1984, pending--

Column 1, lines 10 and 11, "the last two of which are pending" should read --the last three of which are pending--.

Signed and Sealed this

*Second* Day of *September 1986*

[SEAL]

*Attest:*

DONALD J. QUIGG

*Attesting Officer*

*Commissioner of Patents and Trademarks*